US006296304B1

(12) United States Patent
Zheng

(10) Patent No.: US 6,296,304 B1
(45) Date of Patent: Oct. 2, 2001

(54) INCLINED BACK SUPPORT ARRANGEMENT FOR FOLDING FURNITURE

(76) Inventor: Edward Zheng, 1736 Wright Ave., La Verne, CA (US) 91750

( * ) Notice: Subject to any disclaimer, the term of this patent is extended or adjusted under 35 U.S.C. 154(b) by 0 days.

(21) Appl. No.: 09/507,253

(22) Filed: Feb. 18, 2000

(51) Int. Cl.[7] ..... A47C 4/28

(52) U.S. Cl. ..... 297/45; 297/21; 297/366; 297/376

(58) Field of Search ..... 297/56, 42, 45, 297/16.1, 376, 366, 19, 21, 22

(56) References Cited

U.S. PATENT DOCUMENTS 5,975,626 * 11/1999 Aycock .
5,984,406 * 11/1999 Lee .
6,149,238 * 11/2000 Tsai .

* cited by examiner

*Primary Examiner*—Milton Nelson, Jr.
(74) *Attorney, Agent, or Firm*—Raymond Y. Chan; David & Raymond Patent Group

(57) ABSTRACT

An inclined back support arrangement for folding furniture includes a pair of back support joints pivotally connected to two bottom ends of two back frame legs and a pair of inclination locker for pivotally coupling the two back support joints with two lower portions of the two rear side crossed legs of the seat frame respectively, so as to inclinedly support the two back frame legs in position. Moreover, by varying the coupling position of the two rear side crossed legs with the two bottom ends of the two back frame legs can adjust the inclination of the two back frame legs of the back frame.

24 Claims, 11 Drawing Sheets

INCLINED BACK SUPPORT ARRANGEMENT FOR FOLDING FURNITURE

BACKGROUND OF THE PRESENT INVENTION

1. Field of Invention

The present invention relates to folding furniture, and more particularly to an inclined back support arrangement for folding furniture which provides the user of the folding furniture with an inclined back support.

2. Description of Related Arts

Referring to FIG. 1 of the drawing, a conventional foldable chair comprises a foldable chair frame A1 constructed by metal tubes and a seat fabric B1. The foldable chair frame A1 comprises a plurality of construction tubes A11 to construct a back frame A2 and a seat frame A3 for supporting the fabric seat B1. The seat frame A1 comprises a front pair, a back pair and two side pairs of the construction tubes, wherein each pair of the construction tubes are pivotally connected together where they cross so that the chair frame A1 can be easily unfolded to provide a rigid cross-support for use and be folded up for storage.

Because such a conventional foldable chair can be quickly and easily unfolded for use and folded into a compact for carriage, a user can carry the foldable chair to everywhere such as campground or beach. However, the back frame A2 of the conventional foldable chair merely comprises a pair of elongated construction tubes A21 vertically connected to the seat frame A3 for supporting a back support portion B11 of the fabric seat B1 in an upright manner.

Accordingly, the user of such conventional upright foldable chair is forced to sit upright on the chair. In other words, none of the conventional folding chair provides an inclined back support that enables the user to inclinedly lay his or her back thereon comfortably.

Moreover, most people trend to sit down with their back inclined backwards; therefore most of the furniture chairs are designed to have an inclined back. However, such upright back frame A2 of the conventional folding chair fails to well support the inclined back of the user.

SUMMARY OF THE PRESENT INVENTION

A main object of the present invention is to provide an inclined back support arrangement specifically incorporated with folding furniture, which can well support a user's back so that the user is capable of lying on the folding furniture naturally and comfortably.

Another object of the present invention is to provide an inclined back support arrangement for folding furniture which can be quickly and easily folded into a compact unit for carriage and storage and unfolded for use.

Another object of the present invention is to provide an inclined back support arrangement for folding furniture, which inclination is adjustable, that is the slope of the back frame can be adjusted to fittingly support the user's back.

Another object of the present invention is to provide an inclined back support arrangement for folding furniture, which enables the back frame to be inclinedly supported without altering or complicating the back frame and seat frame structure.

Another object of the present invention is to provide an inclined back support arrangement for folding furniture, which can even reinforce the structure of the seat frame and enhance the seat frame's weight supporting ability.

Another object of the present invention is to provide an inclined back support arrangement for folding furniture, wherein the weight of the user applied on the seat frame and the back frame will further ensure the construction of the inclined back support arrangement.

Accordingly, in order to accomplish the above objects, the present invention provides a folding furniture, comprising a seat frame and a back frame constructed to support a fabric seat thereon.

The seat frame comprising two side leg frames and a construction leg frame foldably supported between the two side leg frames. Each of the side leg frames comprises a front side crossed leg and a rear side crossed leg pivotally connected together where they cross, a front frame joint pivotally connected to a top end of the rear side crossed leg, and a back frame joint pivotally connected to a top end of the front side crossed leg. The back frame comprises a pair of back frame legs slidably passing through the two back frame joints respectively.

The folding furniture further comprises an inclined back support arrangement which comprises a pair of back support coupling means for pivotally coupling two bottom ends of the two back frame legs with two lower portions of the two rear side crossed legs of the seat frame respectively, so as to inclinedly support the two back frame legs in position.

Whereby, by varying the coupling position of the two rear side crossed legs with the two bottom ends of the two back frame legs can adjust the inclination of the two back frame legs of the back frame.

DETAILED DESCRIPTION OF THE PREFERRED EMBODIMENT

Figure 1:
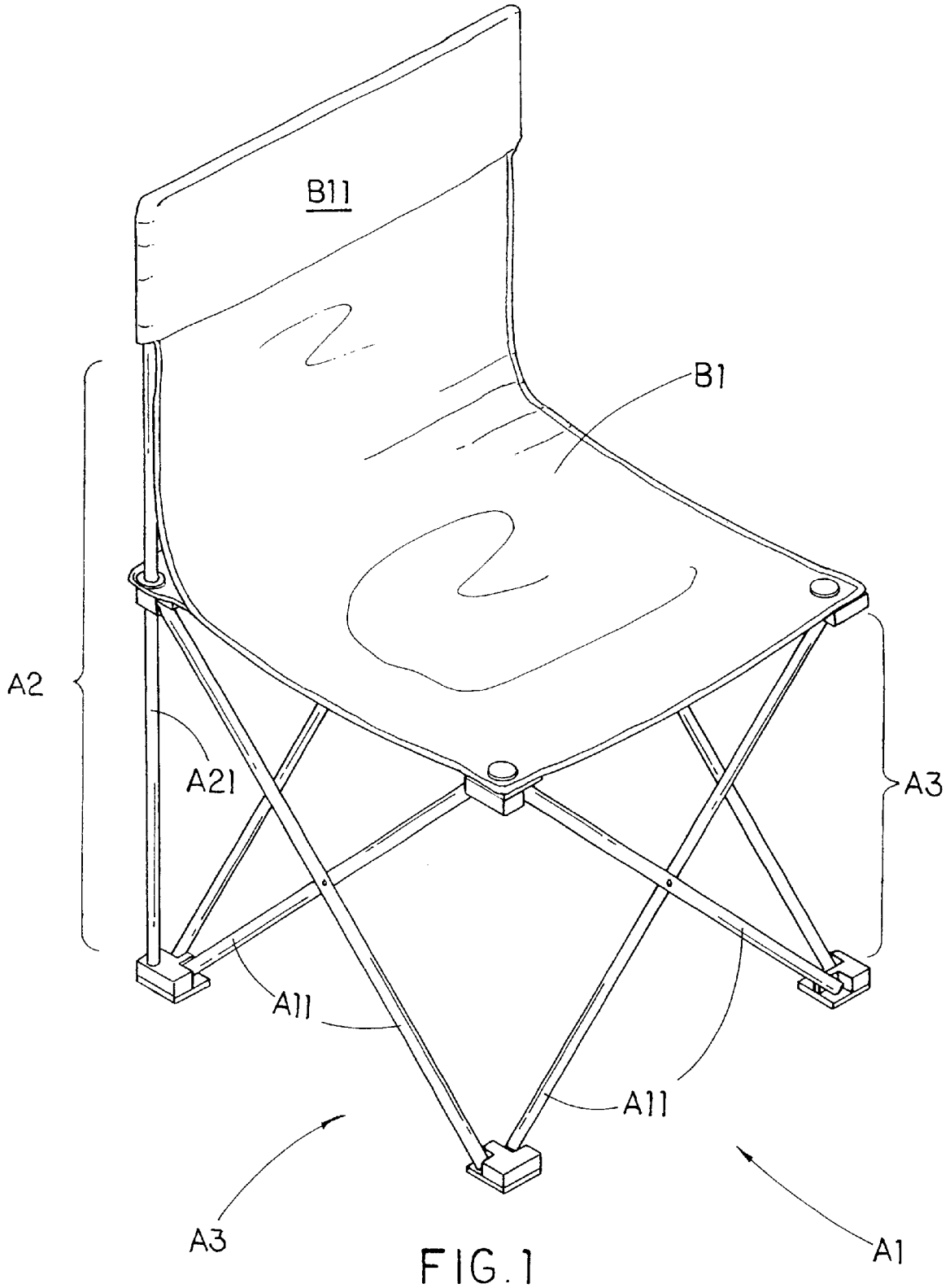
FIG. 1 PRIOR ART
FIG. 1 is a perspective view of a conventional folding chair.

Referring to FIGS. 2 to 6 of the drawing, a folding furniture 1 incorporated with an inclined back support arrangement 30 according to a first preferred embodiment of the present invention is illustrated. The folding furniture 1 of the first preferred embodiment is embodied by a folding chair which comprises a seat frame 10 and a back frame 20 constructed to support a fabric seat 1A thereon.

The seat frame 10 comprising two side leg frames 11, 12 and a construction leg frame 13 foldably supported between the two side leg frames 11, 12. Each of the side leg frames 11, 12 comprises a front side crossed leg 111, 121 and a rear side crossed leg 112, 122 pivotally connected together where they cross, a front frame joint 14, 15 pivotally connected to a top end of the rear side crossed leg 112, 122, and a back frame joint 16, 17 pivotally connected to a top end of the front side crossed leg 111, 121. The back frame 20 comprises a pair of back frame legs 21, 22 slidably passing through the two back frame joints 16, 17 respectively.

Figure 2:
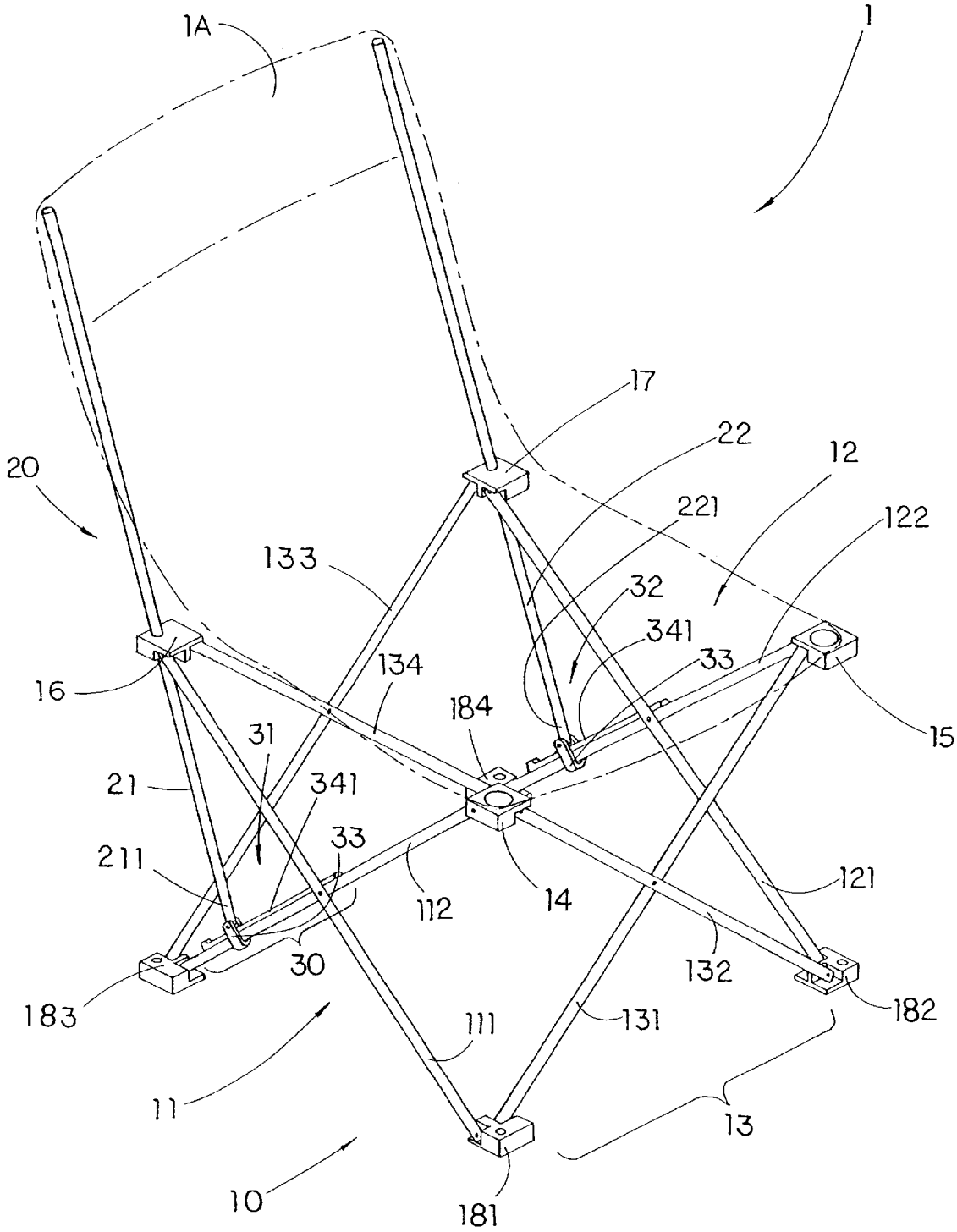
FIG. 2 is a perspective view of a folding furniture incorporated with an inclined back support arrangement according to a first preferred embodiment of the present invention.

According to the preferred embodiment as shown in FIG. 2, the construction leg frame 13 comprises a pair of front crossed legs 131, 132 pivotally connected together where they cross and a pair of rear crossed legs 133, 134 pivotally connected together where they cross. Four top ends of the front and rear crossed legs 131, 132, 133, 134 are pivotally connected to the two front frame joints 14, 15 and the two rear frame joints 16, 17 respectively.

The seat frame 10 further comprises four base frame joints 181, 182, 183, 184. The bottom ends of the front crossed leg 131 and the front side crossed leg 111 are pivotally connected to the first base frame joint 181. The bottom ends of the front crossed leg 132 and the other front side crossed leg 121 are pivotally connected to the second base frame joint 182. The bottom ends of the rear crossed leg 133 and the rear side crossed leg 112 are pivotally connected to the third base frame joint 183. The bottom ends of the rear crossed leg 134 and the other rear side crossed leg 122 are pivotally connected to the fourth base frame joint 184. Furthermore, the top ends of the two front crossed legs 131, 132 are pivotally connected to the two front frame joints 14, 15 respectively, and the top ends of the two rear crossed legs 133, 134 are pivotally connected to the two rear frame joints 16, 17 respectively.

The inclined back support arrangement 30 comprises a pair of back support coupling means 31, 32 for pivotally coupling two bottom ends 211, 221 of the two back frame legs 21, 22 with two lower portions of the two rear side crossed legs 112, 122 of the seat frame 10 respectively, so as to inclinedly support the two back frame legs 21, 22 in position. Moreover, by varying the coupling position of the two rear side crossed legs 112, 122 with the two bottom ends 211, 221 of the two back frame legs 21, 22 can adjust the inclination of the two back frame legs 21, 22 of the back frame 20.

Each of the back support coupling means 31, 32 of the inclined back support arrangement 30 for the folding furniture 1 comprises a back support joint 33 pivotally connected to the bottom end 211 (221) of the respective back frame leg 21 (22) and slidably coupled with the lower portion of the respective rear side crossed legs 112 (122), and an inclination locker 34 for firmly locking up the inclination angle of the respective back frame leg 21 (22) with respect to the seat frame 10 when the folding furniture 1 is fully unfolded as shown in FIG. 2.

Figure 5:
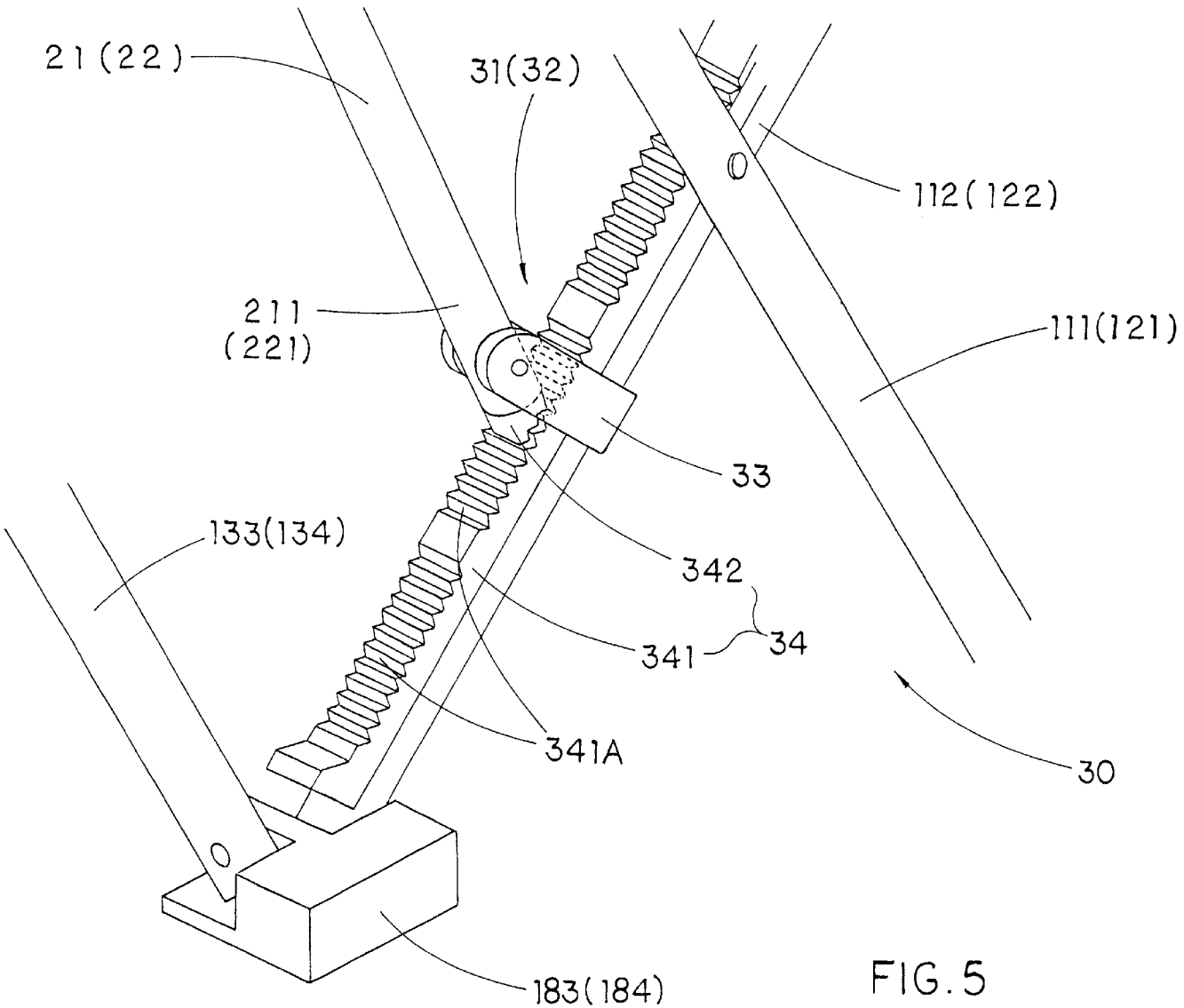
FIG. 5 is a partial perspective view of the inclined back support arrangement incorporated with the folding furniture according to the above first preferred embodiment of the present invention.
Figure 6:
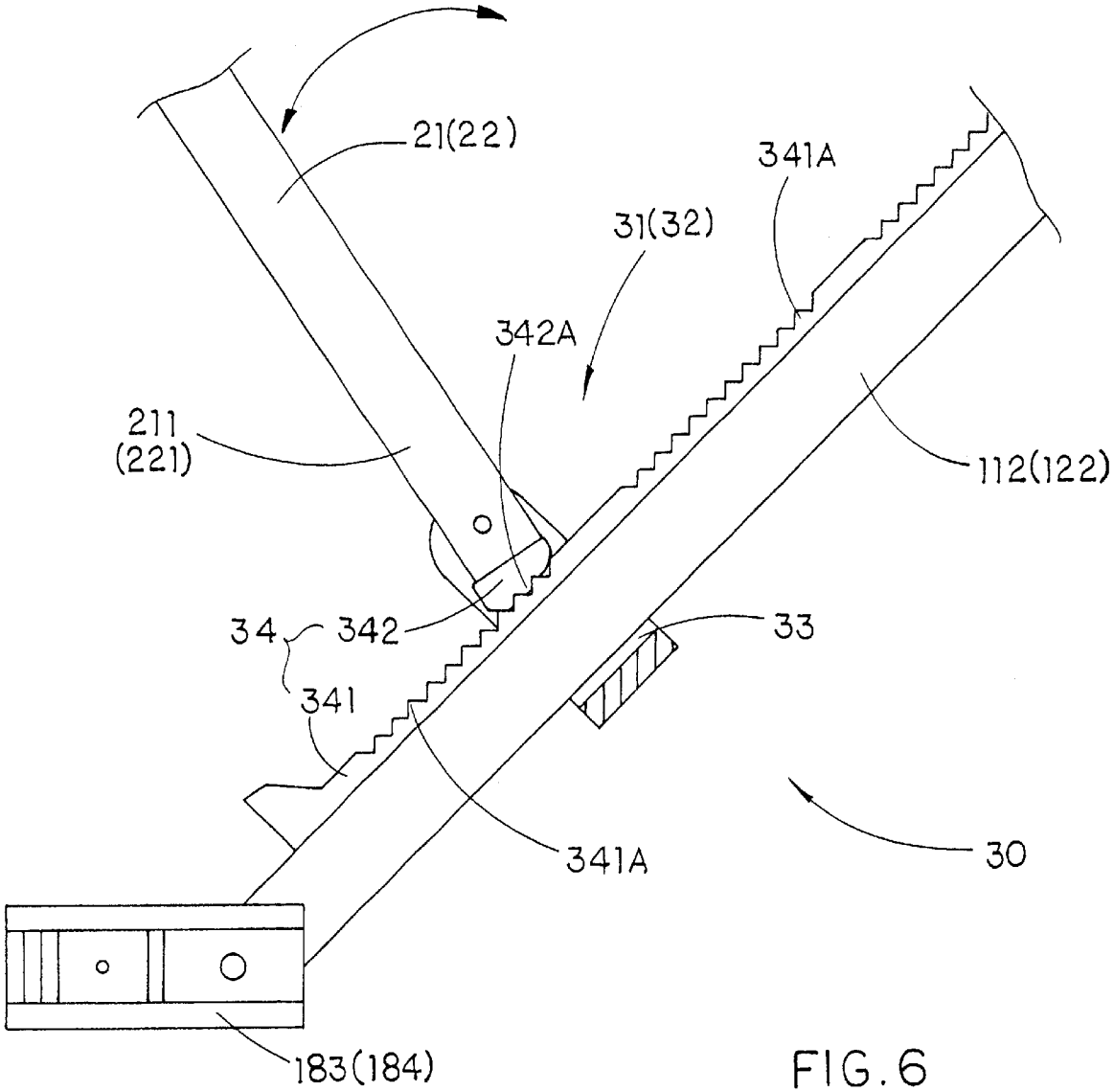
FIG. 6 is a partially sectional side view of the inclined back support arrangement incorporated with the folding furniture according to the above first preferred embodiment of the present invention.

Referring to FIGS. 5 and 6 of the drawing, according to the first preferred embodiment of the present invention, each of the back support joints 33 is a U-shaped member having two ends to pivotally connect the bottom end 211 (221) of the respective back frame leg 21 (22) therebetween, wherein the respective rear side crossed leg 112 (122) is arranged to slidably pass through the back support joints 33. Each of the inclination lockers 34 comprises an engagement rack 341 affixed along an upper side of the lower portion of the respective rear side crossed leg 112 (122), wherein a plurality of engagement teeth 341A evenly provided along an upper side of the engagement rack 341. Each of the inclination lockers 34 further comprises a locking latch 342 coaxially protruded from the bottom end 211 (221) of the respective back frame leg 21 (22) and extended in the back support joint 33, wherein several locking teeth 342A are provided underneath the locking latch 342 opposing the engagement teeth 341A. In which, the locking latch 342 and the engagement rack 341 are arranged in such a manner that when the back frame leg 21 (22) is rotated about the back support joint 33 towards the respective rear side crossed leg 112 (122), the locking latch 342 will move apart from the engagement rack 341 where the locking teeth 342A are disengaged with the engagement teeth 341A so that the back support joint 33 and the back frame leg 21 (22) can be slidably move along the lower portion of the rear side crossed leg 112 (122), and that when the back frame leg 21 (22) is rotated about the back support joint 33 away the respective rear side crossed leg 112 (122), the locking teeth 342A of locking latch 342 will be pressed to engage with the respective engagement teeth 341A of the rear side crossed leg 112 (122).

As shown in FIGS. 2, 5 and 6, the user can adjust the inclination of the back frame 20, i.e. the inclined angle of the two back frame legs 21, 22, by sliding the back support joints 33 to the desired position on the rear side crossed legs 112, 122 and engaging the locking teeth 342A of the locking latches 342 with the corresponding engagement teeth 341A provided at that position on the engagement rack 341, wherein the lower the back support joints 33 positioned, the more upright the back frame 20 is arranged, an that the upper the back support joints 33 positioned, the more inclined the back frame 20 is supported. To fold up the folding furniture 1, disengage the locking latch 342 from the engagement rack 341 and fold the front side crossed legs 111, 121 and the back frame legs 21, 22 towards the rear side crossed legs 112, 122 together.

As shown in FIGS. 2 to 6, when the user sits on the folding furniture 1 which incorporates with the inclined back support arrangement 30, the user's weight applied to the seat frame 10 and the back frame 20 will substantially press the back frame legs 21, 22 apart from the rear side crossed legs 112, 122, and thus ensure the engagement between the locking latch 342 and the engagement rack 341. In other words, the weight of the user will reinforce the engagement of the locking teeth 342A and the engagement teeth 341A and enhance the support the inclined back frame 20.

Figure 3A:
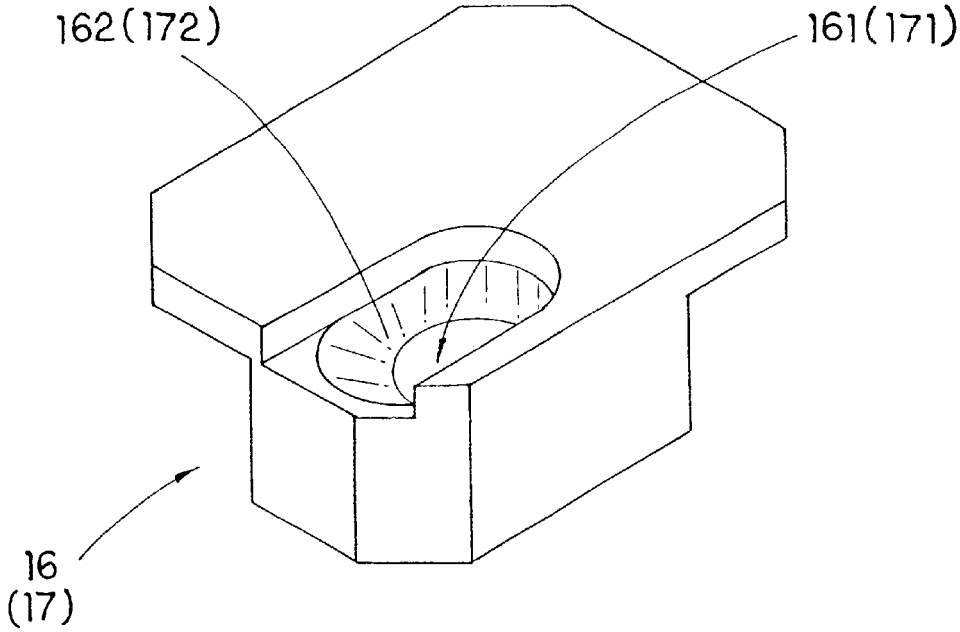
FIG. 3A is a top perspective view of a rear frame joint of the folding furniture according to the above first preferred embodiment of the present invention.
Figure 3B:
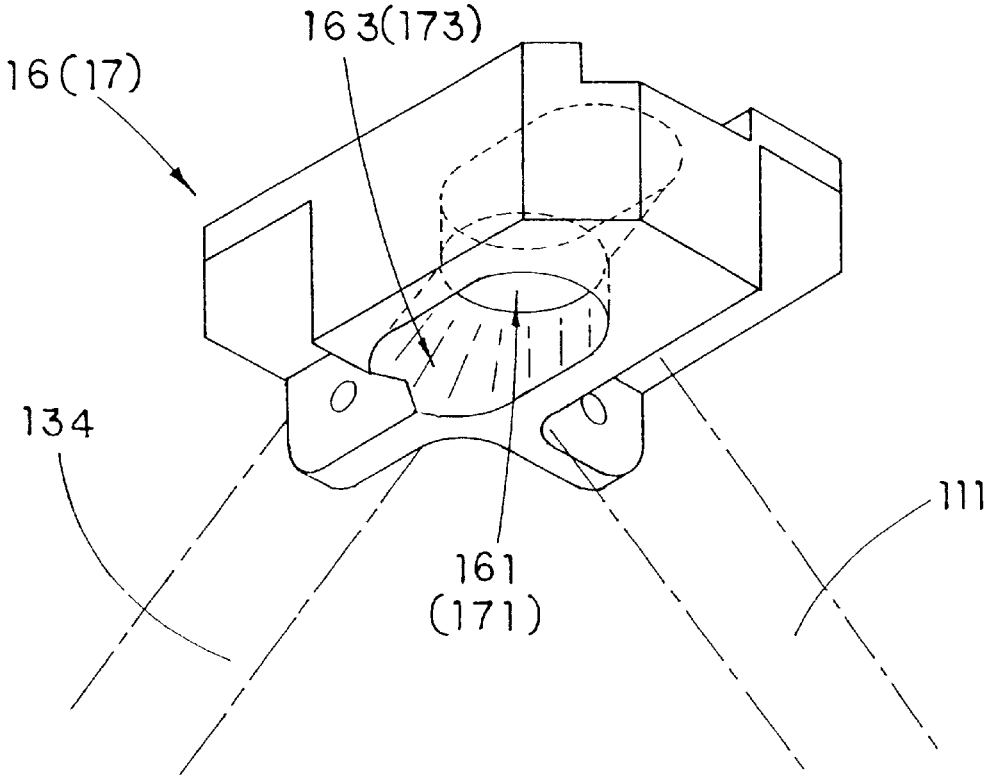
FIG. 3B is a bottom perspective view of the rear frame joint as shown in FIG. 3A.
Figure 4:
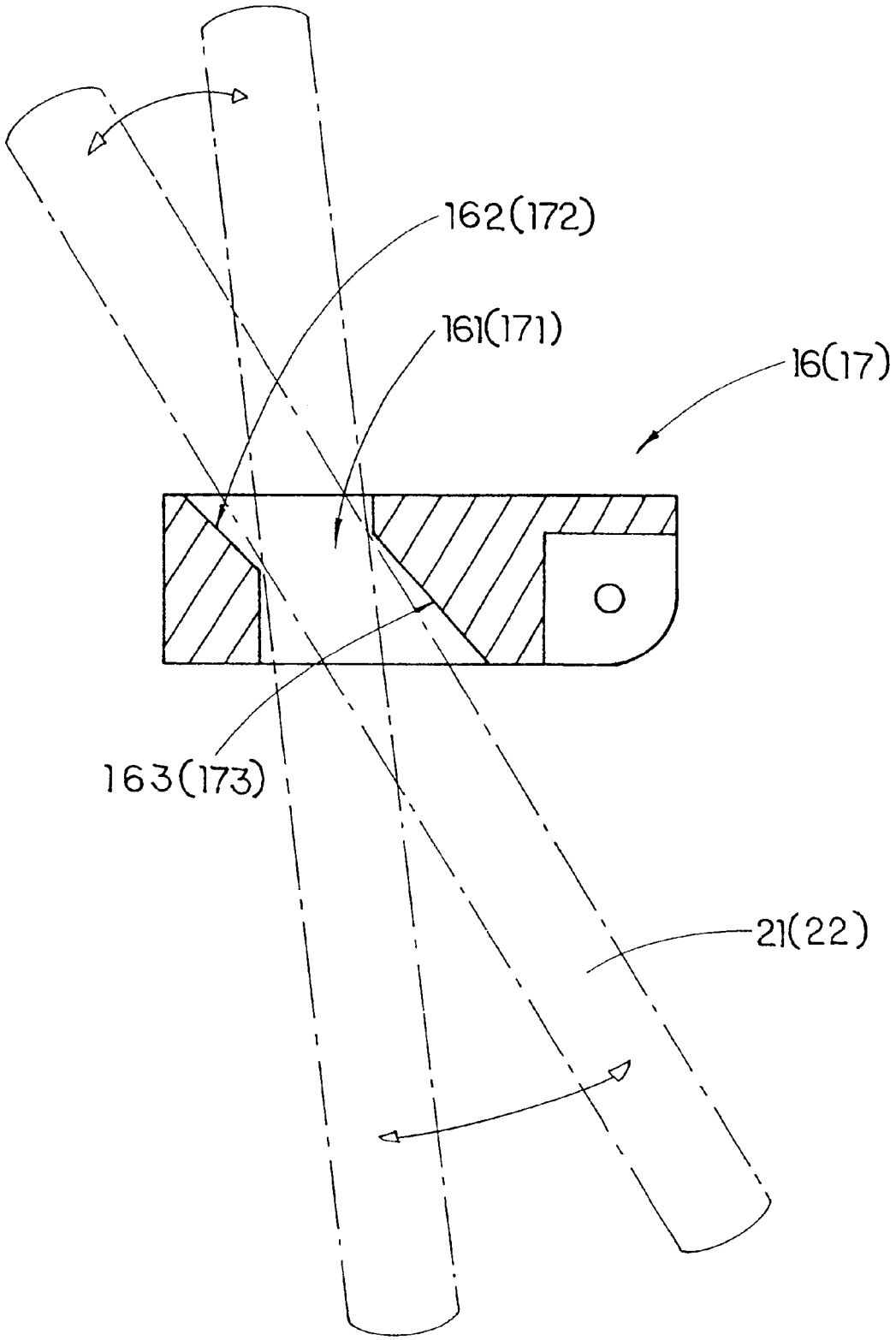
FIG. 4 is a sectional view of the rear frame joint as shown in FIGS. 3A and 3B.

Referring to FIGS. 3A, 3B and 4, each of the rear frame joints 16, 17 has a guiding hole 161 (171) for the back frame leg 21 (22) slidably passing through. An inclined hole is intercrossed with the guiding hole 161 (171) to form an inclined upper surface 162 (172) and an inclined lower surface 163 (173) for respectively supporting the lower side and the upper side of the back frame leg 21 (22) when it is inclined in the unfolded state, as shown in FIG. 4, so as to evenly distribute a downward force applied by the user's weight by the rear frame joints 16, 17 and minimize a stress around the rear frame joints 16, 17. Since the back frame legs 21, 22 are respectively slidably passing through the guiding holes 167, 171 of the two rear frame joints 16, 17, so that when the folding furniture 1 is being folded or unfolded, the two rear frame joints 16, 17 will respectively slide upwardly downwardly along the two back frame legs 21, 22.

Figure 7:
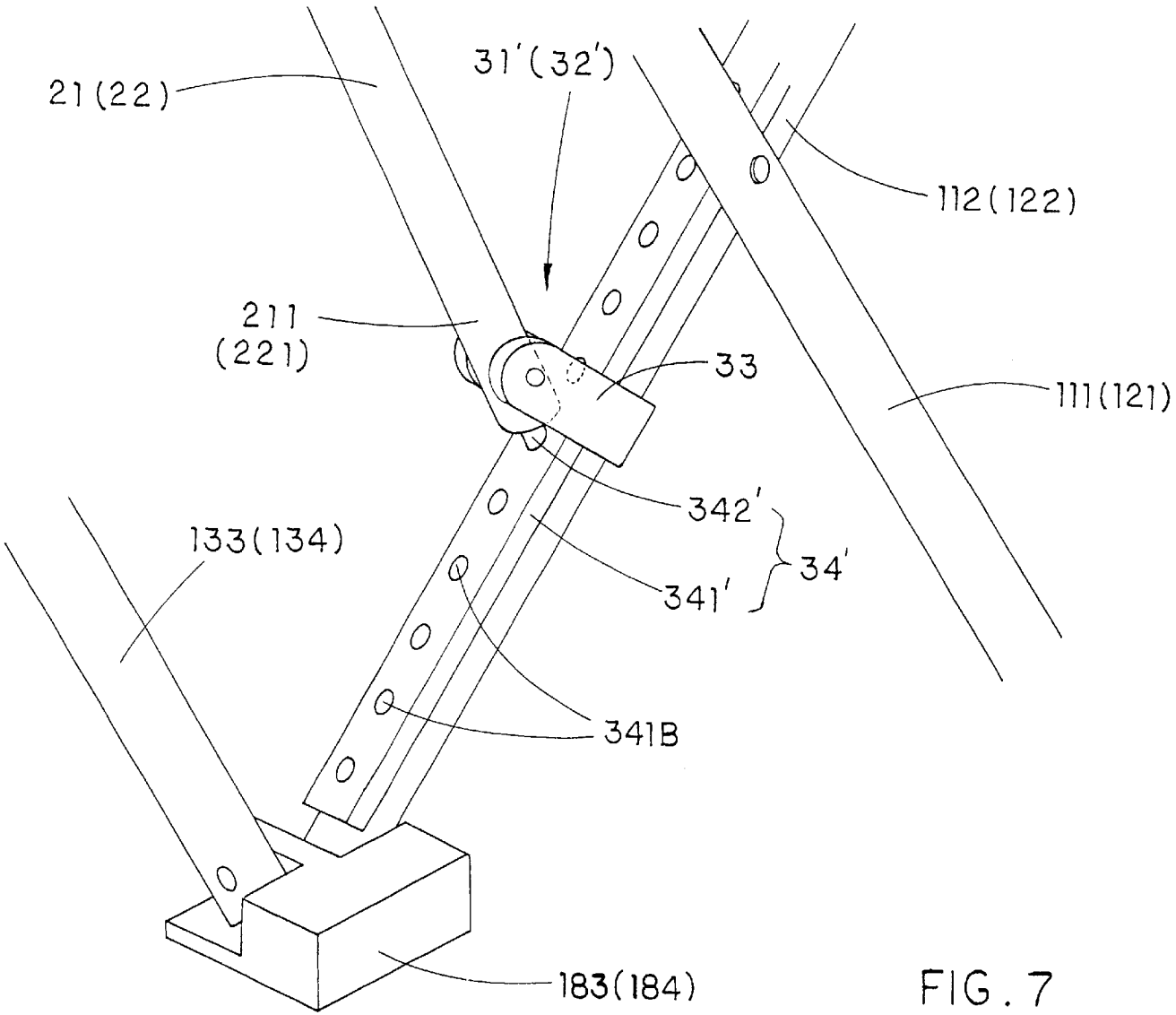
FIG. 7 is a partial perspective view of an alternative mode of the inclined back support arrangement according to the above first preferred embodiment of the present invention.

Referring to FIG. 7 of the drawing, an alternative mode of the back support coupling means 31', 32' for the above first preferred embodiment is illustrated, wherein the engagement teeth 341A is replaced by a plurality of engagement sockets 341B of the engagement rack 341' and the locking latch 342 is substituted by a locking plug 342'. Therefore, the teeth engagement of the inclination locker 34 in the above first preferred embodiment is substituted by the alternative inclination locker 34' by selectively inserting the locking plug 342' into one of the engagement sockets 341B.

Figure 8:
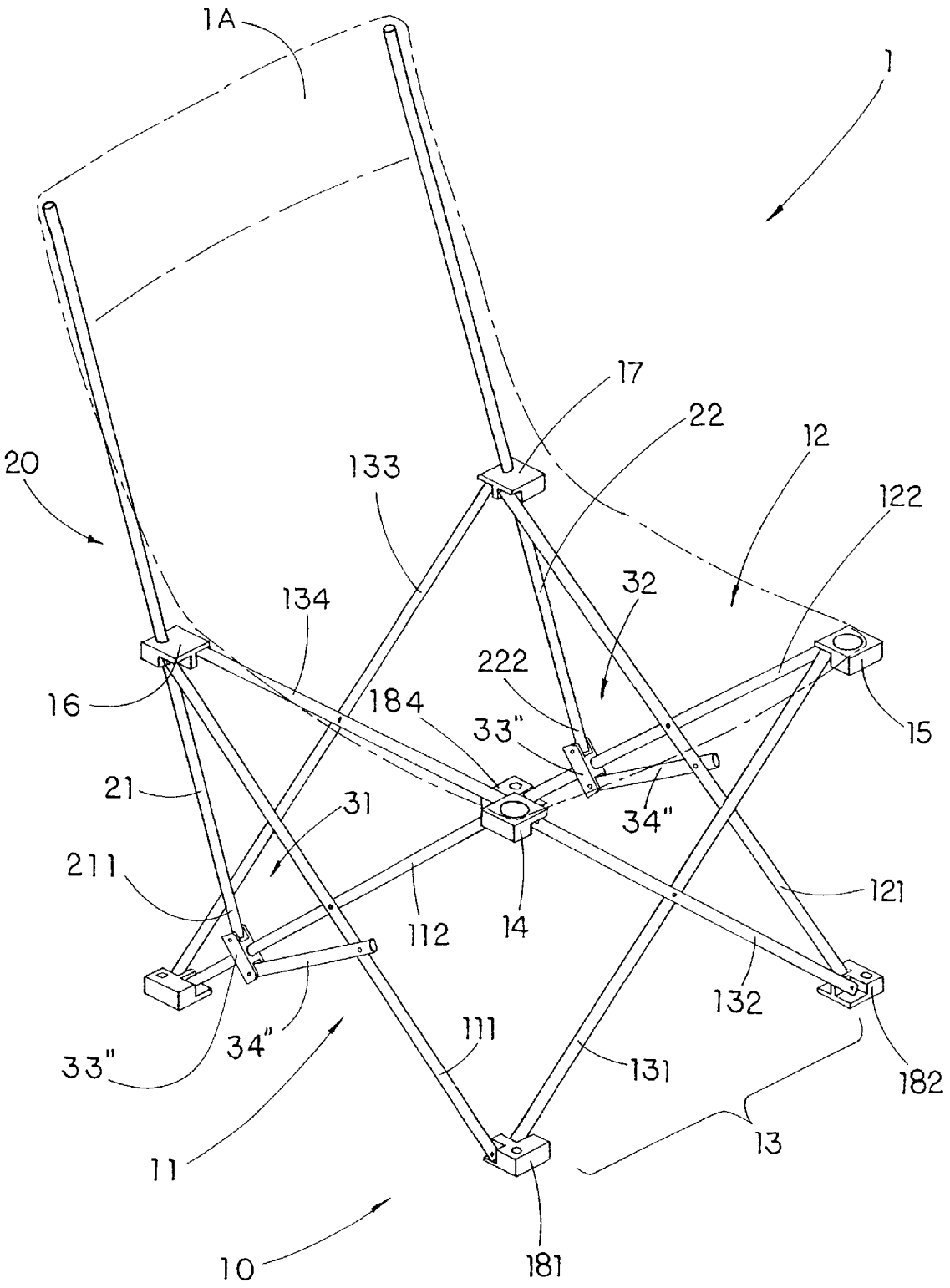
FIG. 8 is a perspective view of a folding furniture incorporated with an inclined back support arrangement according to a second preferred embodiment of the present invention.
Figure 9:
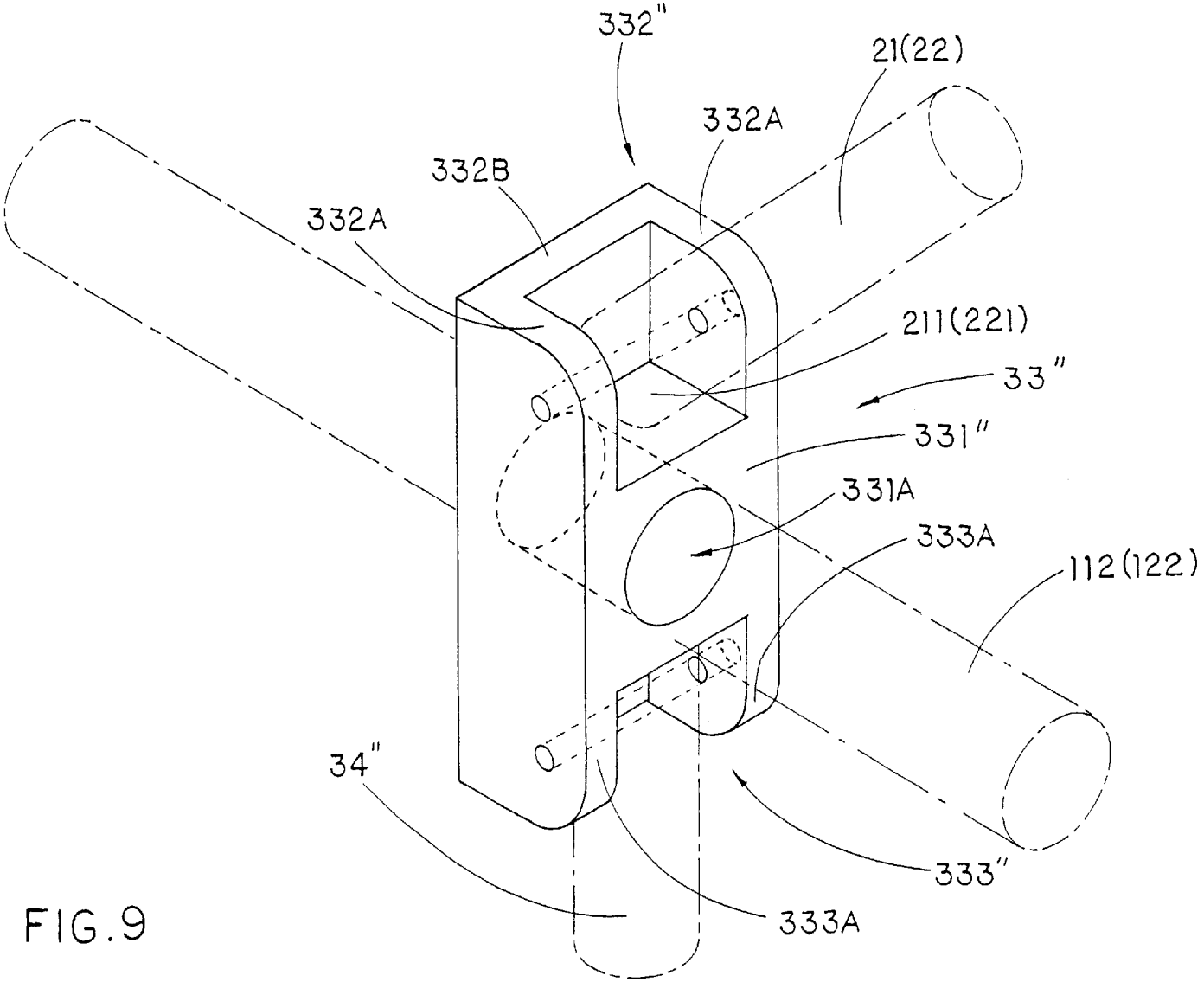
FIG. 9 is a perspective view of a back support joint of the back support means according to the above preferred second preferred embodiment of the present invention.

Referring to FIGS. 8 to 11, since some users do not need the adjustable inclined back support arrangement as suggested in the above preferred embodiment, a second preferred embodiment of the present invention is illustrated, wherein each of the back support coupling means 31, 32 of the inclined back support arrangement 30 for the folding furniture 1 comprises a back support joint 33" pivotally connected to the bottom end 211 (221) of the respective back frame leg 21 (22) and an inclination locker 34" for firmly locking up the inclination angle of the respective back frame leg 21, 22 with respect to the seat frame 10 when the folding furniture 1 is unfolded as shown in FIG. 8.

Each of the back support joints 33" comprises a slider body 331" and an upper and lower pivot joints 332", 333" integrally extended at two ends of the slider body 331". The slider body 331" has a slider hole 331A which has a diameter slightly larger than the respective rear side crossed leg 112, 122 and transversally extended through slider body 331" for the respective rear side crossed leg 112, 122 slidably passing through. Each of the two upper pivot joints 332" comprises two parallel arms 332A to pivotally connect the bottom end 211, 221 of the respective back frame leg 21, 22 therebetween. According to the second embodiment, each of the upper pivot joints 332" can further has an end wall 332B integrally extended between the two parallel arms 332A so as to limit the rotation angle of the back frame leg 21, 22 and support the back frame leg 21, 22 when it is unfolded to inclinedly extend with respect to the rear side crossed leg 112, 122.

Each of the inclination lockers 34" is a support bar having a first end pivotally connected to the lower pivot joint 333" of the respective back support joint 33" and a second end pivotally connected to a predetermined position of a lower portion of the respective front side crossed leg 111, 121. Each of the two lower pivot joints 333" comprises two parallel arms 333A to pivotally connect the first end of the inclination locker 34" therebetween. According to the second embodiment, each of the lower pivot joints 333" may further has an end wall 333B integrally extended between the two parallel arms 333A so as to limit the rotation angle of the inclination locker 34".

Figure 10:
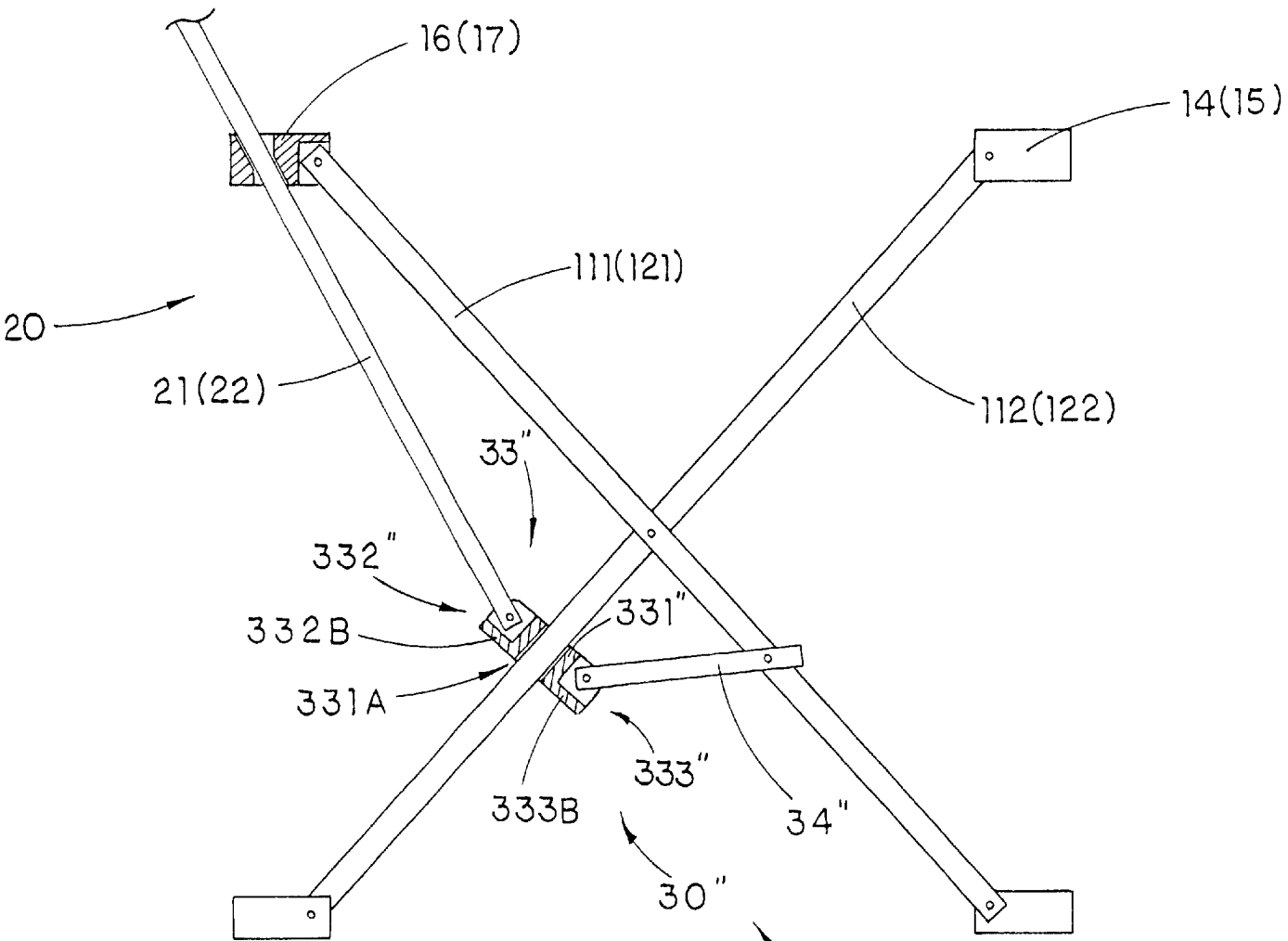
FIG. 10 a partially sectional side view of the folding furniture incorporated with the inclined back support arrangement according to the above second preferred embodiment of the present invention.
Figure 11:
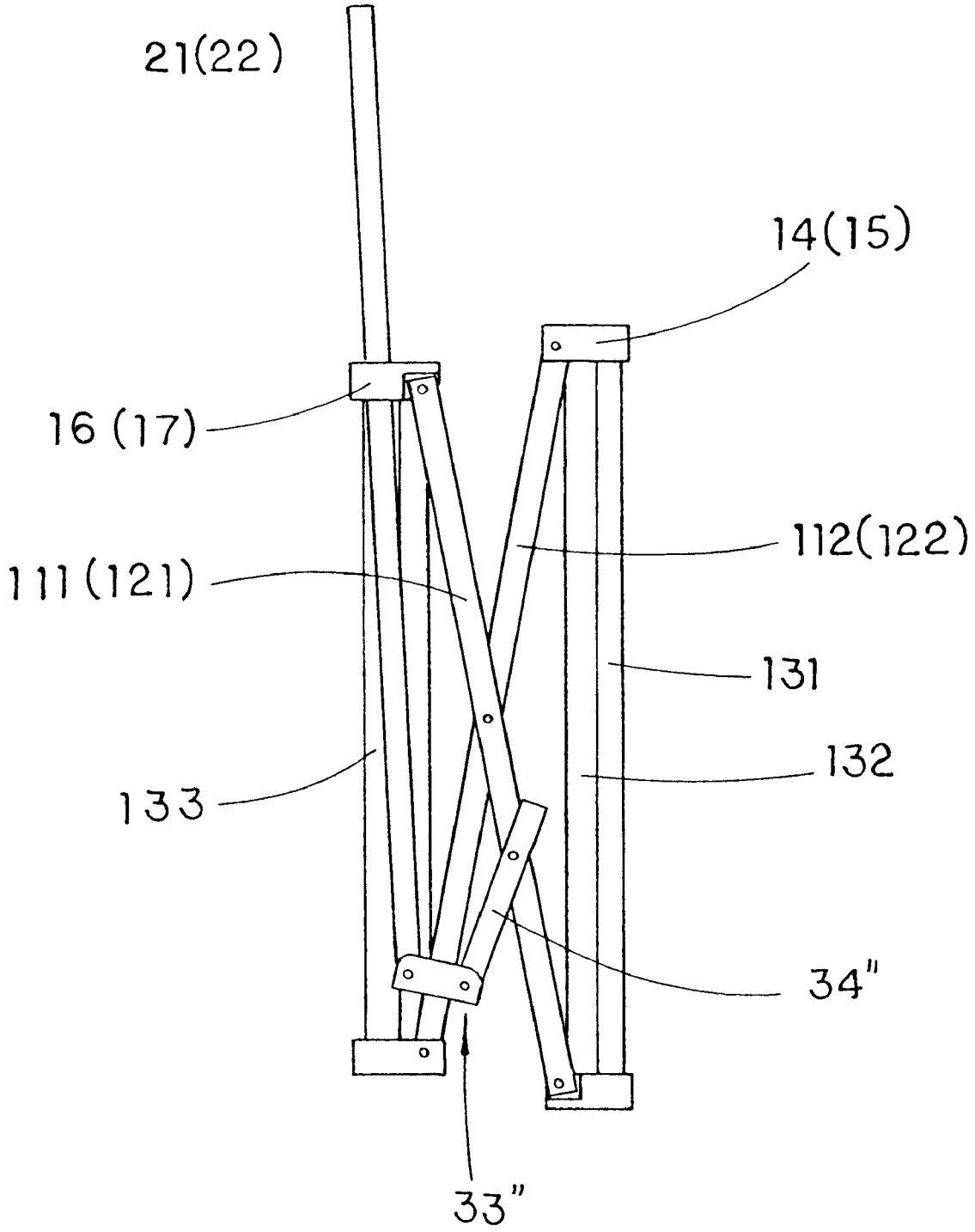
FIG. 11 a side view of the folding furniture, after folded up, according to the above second preferred embodiment of the present invention.

The length of the inclination locker 34" and where the second end of the inclination locker 34" is connected to the respective front side crossed leg 111, 121 determine the inclination of the back frame 20, i.e. the inclined angle of the back frame legs 21, 22. To upwardly slide the back support joints 33" along the two rear side crossed legs 112, 122 respectively will unfold the folding furniture 1 as shown in FIGS. 8 and 10. To downwardly slide the back support joints 33" along the two rear side crossed legs 112, 122 respectively will fold up the folding furniture 1 as shown in FIG. 11. The inclined back support arrangement 30" of the second preferred embodiment provides a rigid frame structure and a fixed inclination for the back frame 20, The inclination locker 34" substantially supports the back frame 20, i.e. the two back frame legs 21, 22. The weight of the user will also ensure the inclined back support construction.

In view of the above preferred embodiments, the present invention can be concluded to provide the following advantages.

1. It can well support a user's back so that the user is capable of lying on the folding furniture naturally and comfortably.

2. The folding furniture incorporated with the inclined back support arrangement can be quickly and easily folded into a compact unit for carriage and storage and unfolded for use.

3. The inclination of the first embodiment is adjustable, that is the slope of the back frame can be adjusted to fittingly support the user's back.

4. It enables the back frame to be inclinedly supported without altering or complicating the back frame and seat frame structure.

5. It can even reinforce the structure of the seat frame and enhance the seat frame's weight supporting ability.

6. The weight of the user applied on the seat frame and the back frame will further ensure the construction of the inclined back support arrangement.

What is claimed is:

1. A folding furniture, comprising:

a seat frame and a back frame constructed to support a fabric seat thereon, said seat frame comprising two side leg frames and a construction leg frame foldably supported between said two side leg frames, each of said side leg frames comprising a front side crossed leg and a rear side crossed leg pivotally connected together where said front and rear side crossed legs cross, a front frame joint pivotally connected to a top end of said rear side crossed leg, and a back frame joint pivotally connected to a top end of said front side crossed leg, said back frame comprising a pair of back frame legs slidably passing through said two back frame joints respectively; and an inclined back support arrangement which comprises a pair of back support coupling means for pivotally coupling two bottom ends of said two back frame legs with two lower portions of said two rear side crossed legs of said seat frame respectively, so as to inclinedly support said two back frame legs in position.

2. The folding furniture, as recited in claim 1, wherein each of said back frame joints has a guiding hole for said back frame leg slidably passing through, an inclined hole being intercrossed with said guiding hole to form an inclined upper surface and an inclined lower surface for respectively supporting a lower side and a upper side of said back frame leg.

3. The folding furniture, as recited in claim 2, wherein said inclined back support arrangement comprises a pair of back support coupling means for pivotally coupling two bottom ends of said two back frame legs with two lower portions of said two rear side crossed legs of said seat frame respectively, so as to inclinedly support said two back frame legs in position.

4. The folding furniture, as recited in claim 3, wherein each of said back support coupling means comprises a back support joint pivotally connected to said bottom end of said respective back frame leg and slidably coupled with said lower portion of said respective rear side crossed legs, and an inclination locker for firmly locking up an inclination angle of said respective back frame leg with respect to said seat frame when said folding furniture is fully unfolded.

5. The folding furniture, as recited in claim 4, wherein each of said inclination lockers comprises an engagement rack affixed along an upper side of said lower portion of said respective rear side crossed leg, wherein a plurality of engagement teeth being provided along an upper side of said engagement rack, each of said inclination lockers further comprising a locking latch coaxially protruded from said bottom end of said respective back frame leg, wherein at least a locking tooth is provided underneath said locking latch opposing said engagement teeth, wherein said locking latch and said engagement rack are arranged in such a manner that when said back frame leg is rotated about said back support joint towards said respective rear side crossed leg, said locking latch moves apart from said engagement rack where said locking latch is disengaged with said engagement teeth so that said back support joint and said back frame leg are slidably moved along said lower portion of said rear side crossed leg, and that when said back frame leg is rotated about said back support joint away said respective rear side crossed leg, said locking latch is pressed to engage with said respective engagement teeth of said rear side crossed leg.

6. The folding furniture, as recited in claim 4, wherein each of said inclination lockers comprises an engagement rack affixed along an upper side of said lower portion of said respective rear side crossed leg, wherein a plurality of engagement sockets being provided along an upper side of said engagement rack, each of said inclination lockers is a locking plug coaxially protruded from said bottom end of said respective back frame leg in such manner that said inclination lockers are engaged with said engagement racks respectively by selectively inserting said locking plug into one of said engagement sockets.

7. The folding furniture, as recited in claim 4, wherein each of said back support joints is a U-shaped member having two ends to pivotally connect said bottom end of said respective back frame leg therebetween, wherein said respective rear side crossed leg is arranged to slidably pass through said back support joint.

8. The folding furniture, as recited in claim 7, wherein each of said inclination lockers comprises an engagement rack affixed along an upper side of said lower portion of said respective rear side crossed leg, wherein a plurality of engagement teeth being provided along an upper side of said engagement rack, each of said inclination lockers further comprising a locking latch coaxially protruded from said bottom end of said respective back frame leg, wherein at least a locking tooth is provided underneath said locking latch opposing said engagement teeth, wherein said locking latch and said engagement rack are arranged in such a manner that when said back frame leg is rotated about said back support joint towards said respective rear side crossed leg, said locking latch moves apart from said engagement rack where said locking latch is disengaged with said engagement teeth so that said back support joint and said back frame leg are slidably moved along said lower portion of said rear side crossed leg, and that when said back frame leg is rotated about said back support joint away said respective rear side crossed leg, said locking latch is pressed to engage with said respective engagement teeth of said rear side crossed leg.

9. The folding furniture, as recited in claim 7, wherein each of said inclination lockers comprises an engagement rack affixed along an upper side of said lower portion of said respective rear side crossed leg, wherein a plurality of engagement sockets being provided along an upper side of said engagement rack, each of said inclination lockers is a locking plug coaxially protruded from said bottom end of said respective back frame leg in such manner that said inclination lockers are engaged with said engagement racks respectively by selectively inserting said locking plug into one of said engagement sockets.

10. The folding furniture, as recited in claim 4, wherein each of said back support joints comprises a slider body, and an upper pivot joint and a lower pivot joint integrally extended at two ends of said slider body, said slider body having a slider hole which has a diameter slightly larger than said respective rear side crossed leg and transversally extended through slider body for said respective rear side crossed leg slidably passing through, said two upper pivot joints being pivotally connected said bottom ends of said two back frame legs respectively, each of said inclination lockers being a support bar having a first end pivotally connected to said lower pivot joint of said respective back support joint and a second end pivotally connected to a predetermined position of a lower portion of said respective front side crossed leg, wherein said two lower pivot joints are pivotally connected to said first ends of said two inclination lockers.

11. The folding furniture, as recited in claim 10, wherein each of said two upper pivot joints comprises two parallel arms to pivotally connect said bottom end of said respective back frame leg therebetween and each of said two lower pivot joints comprises two parallel arms to pivotally connect said first end of said inclination locker therebetween.

12. The folding furniture, as recited in claim 11, wherein each of said upper pivot joints further has an end wall integrally extended between said two parallel arms so as to limit said rotation angle of said respective back frame leg.

13. The folding furniture, as recited in claim 12, wherein each of said lower pivot joints further has an end wall integrally extended between said two parallel arms so as to limit said rotation angle of said inclination locker.

14. The folding furniture, as recited in claim 1, wherein said inclined back support arrangement comprises a pair of back support coupling means for pivotally coupling two bottom ends of said two back frame legs with two lower portions of said two rear side crossed legs of said seat frame respectively, so as to inclinedly support said two back frame legs in position.

15. The folding furniture, as recited in claim 14, wherein each of said back support coupling means comprises a back support joint pivotally connected to said bottom end of said respective back frame leg and slidably coupled with said lower portion of said respective rear side crossed legs, and an inclination locker for firmly locking up an inclination angle of said respective back frame leg with respect to said seat frame when said folding furniture is fully unfolded.

16. The folding furniture, as recited in claim 15, wherein each of said inclination lockers comprises an engagement rack affixed along an upper side of said lower portion of said respective rear side crossed leg, wherein a plurality of engagement teeth being provided along an upper side of said engagement rack, each of said inclination lockers further comprising a locking latch coaxially protruded from said bottom end of said respective back frame leg, wherein at least a locking tooth is provided underneath said locking latch opposing said engagement teeth, wherein said locking latch and said engagement rack are arranged in such a manner that when said back frame leg is rotated about said back support joint towards said respective rear side crossed leg, said locking latch moves apart from said engagement rack where said locking latch is disengaged with said engagement teeth so that said back support joint and said back frame leg are slidably moved along said lower portion of said rear side crossed leg, and that when said back frame leg is rotated about said back support joint away said respective rear side crossed leg, said locking latch is pressed to engage with said respective engagement teeth of said rear side crossed leg.

17. The folding furniture, as recited in claim 15, wherein each of said inclination lockers comprises an engagement rack affixed along an upper side of said lower portion of said respective rear side crossed leg, wherein a plurality of engagement sockets being provided along an upper side of said engagement rack, each of said inclination lockers is a locking plug coaxially protruded from said bottom end of said respective back frame leg in such manner that said inclination lockers are engaged with said engagement racks respectively by selectively inserting said locking plug into one of said engagement sockets.

18. The folding furniture, as recited in claim 15, wherein each of said back support joints is a U-shaped member having two ends to pivotally connect said bottom end of said respective back frame leg therebetween, wherein said respective rear side crossed leg is arranged to slidably pass through said back support joint.

19. The folding furniture, as recited in claim 18, wherein each of said inclination lockers comprises an engagement rack affixed along an upper side of said lower portion of said respective rear side crossed leg, wherein a plurality of engagement teeth being provided along an upper side of said engagement rack, each of said inclination lockers further comprising a locking latch coaxially protruded from said bottom end of said respective back frame leg, wherein at least a locking tooth is provided underneath said locking latch opposing said engagement teeth, wherein said locking latch and said engagement rack are arranged in such a manner that when said back frame leg is rotated about said back support joint towards said respective rear side crossed leg, said locking latch moves apart from said engagement rack where said locking latch is disengaged with said engagement teeth so that said back support joint and said back frame leg are slidably moved along said lower portion of said rear side crossed leg, and that when said back frame leg is rotated about said back support joint away said respective rear side crossed leg, said locking latch is pressed to engage with said respective engagement teeth of said rear side crossed leg.

20. The folding furniture, as recited in claim 18, wherein each of said inclination lockers comprises an engagement rack affixed along an upper side of said lower portion of said respective rear side crossed leg, wherein a plurality of engagement sockets being provided along an upper side of said engagement rack, each of said inclination lockers is a locking plug coaxially protruded from said bottom end of said respective back frame leg in such manner that said inclination lockers are engaged with said engagement racks respectively by selectively inserting said locking plug into one of said engagement sockets.

21. The folding furniture, as recited in claim 15, wherein each of said back support joints comprises a slider body, and an upper pivot joint and a lower pivot joint integrally extended at two ends of said slider body, said slider body having a slider hole which has a diameter slightly larger than said respective rear side crossed leg and transversally extended through slider body for said respective rear side crossed leg slidably passing through, said two upper pivot joints being pivotally connected said bottom ends of said two back frame legs respectively, each of said inclination lockers being a support bar having a first end pivotally connected to said lower pivot joint of said respective back support joint and a second end pivotally connected to a predetermined position of a lower portion of said respective front side crossed leg, wherein said two lower pivot joints are pivotally connected to said first ends of said two inclination lockers.

22. The folding furniture, as recited in claim 21, wherein each of said two upper pivot joints comprises two parallel arms to pivotally connect said bottom end of said respective back frame leg therebetween and each of said two lower pivot joints comprises two parallel arms to pivotally connect said first end of said inclination locker therebetween.

23. The folding furniture, as recited in claim 22, wherein each of said upper pivot joints further has an end wall integrally extended between said two parallel arms so as to limit said rotation angle of said respective back frame leg.

24. The folding furniture, as recited in claim 22, wherein each of said lower pivot joints further has an end wall integrally extended between said two parallel arms so as to limit said rotation angle of said inclination locker.

* * * * *

US006296304C1

(12) INTER PARTES REEXAMINATION CERTIFICATE (967th)

United States Patent
Zheng

(10) Number: US 6,296,304 C1
(45) Certificate Issued: Oct. 14, 2014

(54) INCLINED BACK SUPPORT ARRANGEMENT FOR FOLDING FURNITURE

(75) Inventor: Edward Zheng, La Verne, CA (US)

(73) Assignee: Tofasco of America, Inc., La Verne, CA (US)

Reexamination Request:
No. 95/000,031, Dec. 10, 2003

Reexamination Certificate for:
Patent No.: 6,296,304
Issued: Oct. 2, 2001
Appl. No.: 09/507,253
Filed: Feb. 18, 2000

(51) Int. Cl.
*A47C 4/28* (2006.01)

(52) U.S. Cl.
USPC ..... 297/45; 297/21; 297/366; 297/367

(58) Field of Classification Search
None
See application file for complete search history.

(56) References Cited

To view the complete listing of prior art documents cited during the proceeding for Reexamination Control Number 95/000,031, please refer to the USPTO's public Patent Application Information Retrieval (PAIR) system under the Display References tab.

*Primary Examiner* — Matthew C. Graham

(57) ABSTRACT

An inclined back support arrangement for folding furniture includes a pair of back support joints pivotally connected to two bottom ends of two back frame legs and a pair of inclination locker for pivotally coupling the two back support joints with two lower portions of the two rear side crossed legs of the seat frame respectively, so as to inclinedly support the two back frame legs in position. Moreover, by varying the coupling position of the two rear side crossed legs with the two bottom ends of the two back frame legs can adjust the inclination of the two back frame legs of the back frame.

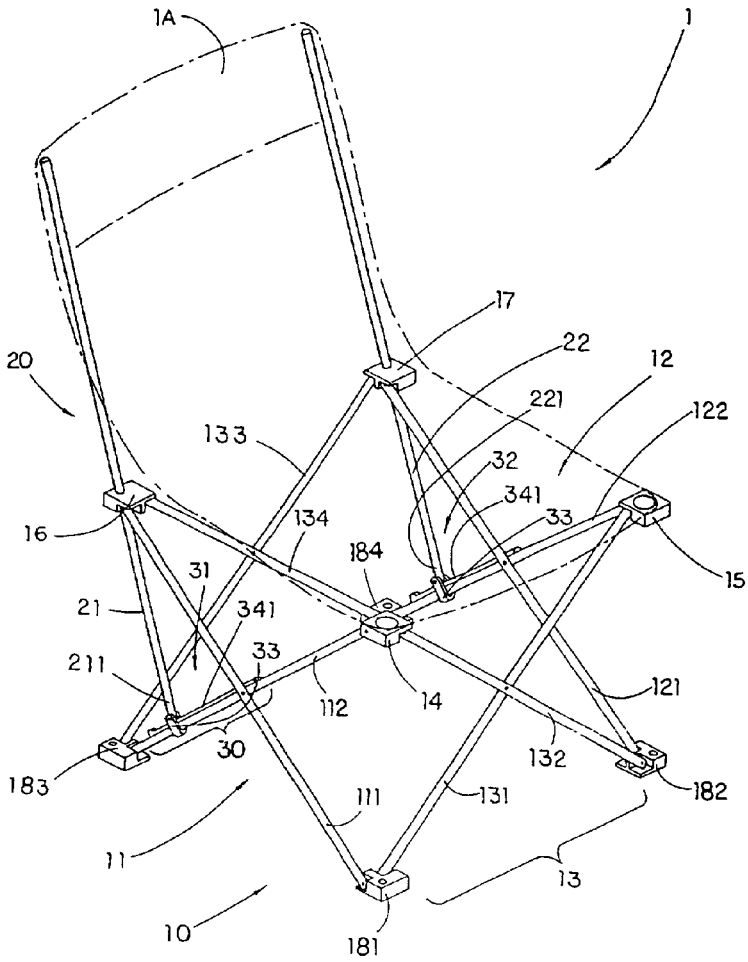

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-7 and 14-15 are cancelled.

Claims 8-10, 13 and 16-21 are determined to be patentable as amended.

Claims 11, 12 and 22-24, dependent on an amended claim, are determined to be patentable.

New claims 25-39 are added and determined to be patentable.

8. [The folding furniture, as recited in claim 7,] *A folding furniture, comprising:*

*a seat frame and a back frame constructed to support fabric seat thereon, said seat frame comprising two side leg frames and a construction leg frame foldably supported between said two side leg frames, each of said side leg frames comprising a front side crossed leg and a rear side crossed leg pivotally connected together where said front and rear side crossed legs cross, a front frame joint pivotally connected to a top end of said rear side crossed leg, and a back frame joint pivotally connected to a top end of said front side crossed leg, said back frame comprising a pair of back frame legs slidably passing through said two back frame joints respectively; and*

*an inclined back support arrangement which comprises a pair of back support coupling means for pivotally coupling two bottom ends of said two back frame legs with two lower portions of said two rear side crossed legs of said seat frame respectively, so as to inclinedly support said two back frame legs in position;*

*wherein each of said back support coupling means comprises a back support joint pivotally connected to said bottom end of said respective back frame leg and slidably coupled with said lower portion of said respective rear side crossed legs, and an inclination locker for firmly locking up an inclination angle of said respective back frame leg with respect to said seat frame when said folding furniture is fully unfolded;*

*wherein each of said back support joints is a U-shaped member having two ends to pivotally connect said bottom end of said respective back frame leg therebetween, wherein said respective rear side crossed leg is arranged to slidably pass through said back support joint; and* wherein each of said inclination lockers comprises an engagement rack affixed along an upper side of said lower portion of said respective rear side crossed leg, wherein a plurality of engagement teeth being provided along an upper side of said engagement rack, each of said inclination lockers further comprising a locking latch coaxially protruded from said bottom end of said respective back frame leg, wherein at least a locking tooth is provided underneath said locking latch opposing said engagement teeth, wherein said locking latch and said engagement rack are arranged in such a manner that when said back frame leg is rotated about said back support joint towards said respective rear side crossed leg, said locking latch moves apart from said engagement rack where said locking latch is disengaged with said engagement teeth so that said back support joint and said back frame leg are slidably moved along said lower portion of said rear side crossed leg, and that when said back frame leg is rotated about said back support joint away said respective rear side crossed leg, said locking latch is pressed to engage with said respective engagement teeth of said rear side crossed leg.

9. [The folding furniture, as recited in claim 7,] *A folding furniture, comprising:*

*a seat frame and a back frame constructed to support a fabric seat thereon, said seat frame comprising two side leg frames and a construction leg frame foldably supported between said two side leg frames, each of said side leg frames comprising a front side crossed leg and a rear side crossed leg pivotally connected together where said front and rear side crossed legs cross, a front frame joint pivotally connected to a top end of said rear side crossed leg, and a back frame joint pivotally connected to a top end of said front side crossed leg, said back frame comprising a pair of back frame legs slidably passing through said two back frame joints respectively; and*

*an inclined back support arrangement which comprises a pair of back support coupling means for pivotally coupling two bottom ends of said two back frame legs with two lower portions of said two rear side crossed legs of said seat frame respectively, so as to inclinedly support said two back frame legs in position;*

*wherein each of said back support coupling means comprises a back support joint pivotally connected to said bottom end of said respective back frame leg and slidably coupled with said lower portion of said respective rear side crossed legs, and an inclination locker for firmly locking up an inclination angle of said respective back frame leg with respect to said seat frame when said folding furniture is fully unfolded;*

*wherein etch of said back support joints is a U-shaped member having two ends to pivotally connect said bottom end of said respective back frame leg therebetween, wherein said respective rear side crossed leg is arranged to slidably pass through said back support joint; and* wherein each of said inclination lockers comprises an engagement rack affixed along an upper side of said lower portion of said respective rear side crossed leg, wherein a plurality of engagement sockets being provided along an upper side of said engagement rack, each of said inclination lockers is a locking plug coaxially protruded from said bottom end of said respective back frame leg in such manner that said inclination lockers are engaged with said engagement racks respectively by selectively inserting said locking plug into one of said engagement sockets.

10. [The folding furniture, as recited in claim 4,] *A folding furniture, comprising:*

*a seat frame and a back frame constructed to support a fabric seat thereon, said seat frame comprising two side leg frames and a construction leg frame foldably supported between said two side leg frames, each of said side leg frames comprising a front side crossed leg and a rear side crossed leg pivotally connected together where said front and rear side crossed legs cross, a front frame joint pivotally connected to a top end of said rear side*

*crossed leg, and a back frame joint pivotally connected to a top end of said front side crossed leg, said back frame comprising a pair of back frame legs slidably passing through said two back frame joints respectively; and*

*an inclined back support arrangement which comprises a pair of back support coupling means for pivotally coupling two bottom ends of said two back frame legs with two lower portions of said two rear side crossed legs of said seat frame respectively, so as to inclinedly support said two back frame legs in position;*

*wherein each of said back support coupling means comprises a back support joint pivotally connected to said bottom end of said respective back frame leg and slidably coupled with said lower portion of said respective rear side crossed legs, and an inclination locker for firmly locking up an inclination angle of said respective back frame leg with respect to said seat frame when said folding furniture is fully unfolded; and* wherein each of said back support joints comprises a slider body, and an upper pivot joint and a lower pivot joint integrally extended at two ends of said slider body, said slider body having a slider hole which has a diameter slightly larger than said respective rear side crossed leg and transversally extended through slider body for said respective rear side crossed leg slidably passing through, said two upper pivot joints being pivotally connected said bottom ends of said two back frame legs respectively, each of said inclination lockers being a support bar having a first end pivotally connected to said lower pivot joint of said respective back support joint and a second end pivotally connected to a predetermined position of a lower portion of said respective front side crossed leg, wherein said two lower pivot joints are pivotally connected to said first ends of said two inclination lockers.

13. The folding furniture, as recited in claim [12] *11*, wherein each of said lower pivot joints further has an end wall integrally extended between said two parallel arms so as to limit said rotation angle of said inclination locker.

16. [The folding furniture, as recited in claim 15, wherein each of said inclination lockers comprises an] *A folding furniture, comprising:*

*a seat frame and a back frame constructed to support a fabric seat thereon, said seat frame comprising two side leg frames and a construction leg frame foldably supported between said two side leg frames, each of said side leg frames comprising a front side crossed leg and a rear side crossed leg pivotally connected together where said front and rear side crossed legs cross, a front frame joint pivotally connected to a top end of said rear side crossed leg, and a back frame joint pivotally connected to a top end of said front side crossed leg, said back frame comprising a pair of back frame legs slidably passing through said two back frame joints respectively; and*

*an inclined back support arrangement which comprises a pair of back support coupling means for pivotally coupling two bottom ends of said two back frame legs with two lower portions of said two rear side crossed legs of said seat frame respectively, so as to inclinedly support said two back frame legs in position;*

*wherein each of said back support coupling means comprises a back support joint pivotally connected to said bottom end of said respective back frame leg and slidably coupled with said lower portion of said respective rear side crossed legs, and an inclination locker comprising an engagement rack for firmly locking up an inclination angle of said respective back frame leg with respect to said seat frame when said folding furniture is fully unfolded; and*

*wherein said* engagement rack *is* affixed along an upper side of said lower portion of said respective rear side crossed leg, wherein a plurality of engagement teeth being provided along an upper side of said engagement rack, each of said inclination lockers further comprising a locking latch coaxially protruded from said bottom end of said respective back frame leg, wherein at least a locking tooth is provided underneath said locking latch opposing said engagement teeth, wherein said locking latch and said engagement rack are arranged in such a manner that when said back frame leg is rotated about said back support joint towards said respective rear side crossed leg, said locking latch moves apart from said engagement rack where said locking latch is disengaged with said engagement teeth so that said back support joint and said back frame leg are slidably moved along said lower portion of said rear side crossed leg, and that when said back frame leg is rotated about said back support joint away said respective rear side crossed leg, said locking latch is pressed to engage with said respective engagement teeth of said rear side crossed leg.

17. [The folding furniture, as recited in claim 15, wherein each of said inclination lockers comprises an] *A folding furniture, comprising:*

*a seat frame and a back frame constructed to support a fabric seat thereon, said seat frame comprising two side leg frames and a construction leg frame foldably supported between said two side leg frames, each of said side leg frames comprising a front side crossed leg and a rear side crossed leg pivotally connected together where said front and rear side crossed legs cross, a front frame joint pivotally connected to a top end of said rear side crossed leg, and a back frame joint pivotally connected to a top end of said front side crossed leg, said back frame comprising a pair of back frame legs slidably passing through said two back frame joints respectively; and*

*an inclined back support arrangement which comprises a pair of back support coupling means for pivotally coupling two bottom ends of said two back frame legs with two lower portions of said two rear side crossed legs of said seat frame respectively, so as to inclinedly support said two back frame legs in position;*

*wherein each of said back support coupling means comprising a back support joint pivotally connected to said bottom end a said respective back frame leg and slidably coupled with said lower portion of said respective rear side crossed legs, and an inclination locker comprising an engagement rack for firmly locking up an inclination angle of said respective back frame leg with respect to said seat frame when said folding furniture is fully unfolded; and*

*wherein said* engagement rack *is* affixed along an upper side of said lower portion of said respective rear side crossed leg, wherein a plurality of engagement sockets being provided along an upper side of said engagement rack, each of said inclination lockers is a locking plug coaxially protruded from said bottom end of said respective back frame leg in such manner that said inclination lockers are engaged with said engagement racks respectively by selectively inserting said locking plug into one of said engagement sockets.

18. The folding furniture, as recited in claim [15] *17*, wherein each of said back support joints is a U-shaped member having two ends to pivotally connect said bottom end of said respective back frame leg therebetween, wherein said respective rear side crossed leg is arranged to slidably pass through said back support joint.

19. The folding furniture, as recited in claim 18, wherein [each of said inclination lockers comprises an] *said* engagement rack affixed along an upper side of said lower portion of said respective rear side crossed leg, wherein a plurality of engagement teeth being provided along an upper side of said engagement rack, each of said inclination lockers further comprising a locking latch coaxially protruded from said bottom end of said respective back frame leg, wherein at least a locking tooth is provided underneath said locking latch opposing said engagement teeth, wherein said locking latch and said engagement rack are arranged in such a manner that when said back frame leg is rotated about said back support joint towards said respective rear side crossed leg, said locking latch moves apart from said engagement rack where said locking latch is disengaged with said engagement teeth so that said back support joint and said back frame leg are slidably moved along said lower portion of said rear side crossed leg, and that when said back frame leg is rotated about said back support joint away said respective rear side crossed leg, said locking latch is pressed to engage with said respective engagement teeth of said rear side crossed leg.

20. The folding furniture, as recited in claim 18, wherein [each of said inclination lockers comprises an] *said* engagement rack *is* affixed along an upper side of said lower portion of said respective rear side crossed leg, wherein a plurality of engagement sockets being provided along an upper side of said engagement rack, each of said inclination lockers is a locking plug coaxially protruded from said bottom end of said respective back frame leg in such manner that said inclination lockers are engaged with said engagement racks respectively by selectively inserting said locking plug into one of said engagement sockets.

21. The folding furniture, as recited in claim [15] *17*, wherein each of said back support joints comprises a slider body, and an upper pivot joint and a lower pivot joint integrally extended at two ends of said slider body, said slider body having a slider hole which has a diameter slightly larger than said respective rear side crossed leg and transversally extended through slider body for said respective rear side crossed leg slidably passing through, said two upper pivot joints being pivotally connected said bottom ends of said two back frame legs respectively, each of said inclination lockers being a support bar having a first end pivotally connected to said lower pivot joint of said respective back support joint and a second end pivotally connected to a predetermined position of a lower portion of said respective front side crossed leg, wherein said two lower pivot joints are pivotally connected to said first ends of said two inclination lockers.

*25. A folding furniture, comprising:*

*a seat frame and a back frame constructed to support a fabric seat thereon, said seat frame comprising two side leg frames and a construction leg frame foldably supported between said two side leg frames, each of said side leg frames comprising a front side crossed leg and a rear side crossed leg pivotally connected together where said front and rear side crossed legs cross, a front frame joint pivotally connected to a top end of said rear side crossed leg, and a back frame joint pivotally connected to a top end of said front side crossed leg, said back frame comprising a pair of back frame legs slidably passing through said two back frame joints respectively;*

*an inclined back support arrangement which comprises a pair of back support couplings for pivotally coupling two bottom ends of said two back frame legs with two lower portions of said two rear side crossed legs of said seat frame respectively, so as to inclinedly support said two back frame legs in position; and*

*wherein each of said back frame joints has a guiding hole for said back frame leg slidably passing through, an inclined hole being intercrossed with said guiding hole to form an inclined upper surface and an inclined lower surface for respectively supporting a lower side and a upper side of said back frame leg, said inclined lower surface being inclined with respect to at least one of the top or bottom planes of the back frame joint, said inclined lower surface being non-perpendicular to at least one of the top or bottom planes of said back frame joint.*

*26. A folding furniture, comprising:*

*a seat frame and a back frame constructed to support a fabric seat thereon, said seat frame comprising two side leg frames and a construction leg frame foldably supported between said two side leg frames, each of said side leg frames comprising a front side crossed leg and a rear side crossed leg pivotally connected together where said front and rear side crossed legs cross, a front frame joint pivotally connected to a top end of said rear side crossed leg, and a back frame joint pivotally connected to a top end of said front side crossed leg, said back frame joint having top and bottom surfaces, said back frame comprising a pair of back frame legs slidably passing through said two back frame joints, respectively;*

*wherein each of said back frame joints has a guiding hole for said back frame leg slidably passing through, and an inclined hole, said inclined hole being intercrossed with said guiding hole to form an inclined upper surface and an inclined lower surface, said inclined surfaces being capable of supporting a lower side and a upper side of said back frame leg, said inclined lower surface being inclined with respect to at least one of said top or bottom surfaces of the back frame joint, said inclined lower surface being non-perpendicular to at least one of said top or bottom surfaces of said back frame joint; and*

*an inclined back support arrangement which comprises a pair of back support coupling means, each for pivotally coupling a bottom end of one of said two back frame legs with a lower portion of one of said two rear side crossed legs of said seat frame respectively, so as to support said two back frame legs in one of a plurality of inclined positions;*

*wherein said back frame legs and said back frame joints are capable of supporting a user in plural ones of said inclined positions; and wherein said pair of back support coupling means includes a plurality of locations, spaced along a plane parallel to a longitudinal axis of each of said rear side crossed legs, at which the bottom ends of said respective back frame legs may be coupled, each of said plurality of locations providing a different corresponding angle between said top or bottom surface of one of said back frame joints and one of said back frame legs when said back frame legs are coupled at one of said plurality of locations;*

*wherein each of said back support coupling means comprises a back support joint pivotally connected to said bottom end of said respective back frame leg and slidably coupled with said lower portion of said respective rear side crossed legs, and an inclination locker for*

*firmly locking up an inclination angle of said respective back frame leg with respect to said seat frame when said folding furniture is fully unfolded.*

*27. The folding furniture, as recited in claim 26, wherein each of said inclination lockers comprises an engagement rack affixed along an upper side of said lower portion of said respective rear side crossed leg, wherein a plurality of engagement teeth being provided along an upper side of said engagement rack, each of said inclination lockers further comprising a locking latch coaxially protruded from said bottom end of said respective back frame leg, wherein at least a locking tooth is provided underneath said locking latch opposing said engagement teeth, wherein said locking latch and said engagement rack are arranged in such a manner that when said back frame leg is rotated about said back support joint towards said respective rear side crossed leg, said locking latch moves apart from said engagement rack where said locking latch is disengaged with said engagement teeth so that said back support joint and said back frame leg are slidably moved along said lower portion of said rear side crossed leg, and that when said back frame leg is rotated about said back support joint away said respective rear side crossed leg, said locking latch is pressed to engage with said respective engagement teeth of said rear side crossed leg.*

*28. The folding furniture, as recited in claim 26 wherein each of said inclination lockers comprises an engagement rack affixed along an upper side of said lower portion of said respective rear side crossed leg, wherein a plurality of engagement sockets being provided along an upper side of said engagement rack, each of said inclination lockers is a locking plug coaxially protruded from said bottom end of said respective back frame leg in such manner that said inclination lockers are engaged with said engagement racks respectively by selectively inserting said locking plug into one of said engagement sockets.*

*29. The folding furniture, as recited in claim 26, wherein each of said back support joints is a U-shaped member having two ends to pivotally connect said bottom end of said respective back frame leg therebetween, wherein said respective rear side crossed leg is arranged to slidably pass through said back support joint.*

*30. The folding furniture, as recited in claim 29, wherein each of said inclination lockers comprises an engagement rack affixed along an upper side of said lower portion of said respective rear side crossed leg, wherein a plurality of engagement teeth being provided along an upper side of said engagement rack, each of said inclination lockers further comprising a locking latch coaxially protruded from said bottom end of said respective back frame leg, wherein at least a locking tooth is provided underneath said locking latch opposing said engagement teeth, wherein said locking latch and said engagement rack are arranged in such a manner that when said back frame leg is rotated about said back support joint towards said respective rear side crossed leg, said locking latch moves apart said engagement rack where said locking latch is disengaged with said engagement teeth so that said back support joint and said back frame leg are slidably moved along said lower portion of said rear side crossed leg, and that when said back frame leg is rotated about said back support joint away said respective rear side crossed leg, said locking latch is pressed to engage with said respective engagement teeth of said rear side crossed leg.*

*31. The folding furniture, as recited in claim 29, wherein each of said inclination lockers comprises an engagement rack affixed along an upper side of said lower portion of said respective rear side crossed leg, wherein a plurality of engagement sockets being provided along an upper side of said engagement rack, each of said inclination lockers is a locking plug coaxially protruded from said bottom end of said respective back frame leg in such manner that said inclination lockers are engaged with said engagement racks respectively by selectively inserting said locking plug into one of said engagement sockets.*

*32. The folding furniture, as recited in claim 26, wherein each of said back support joints comprises a slider body, and an upper pivot joint and a lower pivot joint integrally extended at two ends of said slider body, said slider body having a slider hole which has a diameter slightly larger than said respective rear side crossed leg and transversally extended through slider body for said respective rear side crossed leg slidably passing through, said two upper pivot joints is being pivotally connected said bottom ends of said two back frame legs respectively, each of said inclination lockers being a support bar having a first end pivotally connected to said lower pivot joint of said respective back support joint and a second end pivotally connected to a predetermined position of a lower portion of said respective front side crossed leg, wherein said two lower pivot joints are pivotally connected to said first ends of said two inclination lockers.*

*33. The folding furniture, as recited in claim 32, wherein each of said two upper pivot joints comprises two parallel arms to pivotally connect said bottom end of said respective back frame leg therebetween and each of said two lower pivot comprises two parallel arms to pivotally connect said first end of said inclination locker therebetween.*

*34. The folding furniture, as recited in claim 33, wherein each of said upper pivot joints further has an end wall integrally extended between said two parallel arms so as to limit said rotation angle of said respective back frame leg.*

*35. The folding furniture, as recited in claim 34, wherein each of said lower pivot joints further has an end wall integrally extended between said two parallel arms so as to limit said rotation angle of said inclination locker.*

*36. A folding furniture, comprising:*

*a seat frame and a back frame constructed to support a fabric seat thereon, said seat frame comprising two side leg frames and a construction leg frame foldably supported between said two side leg frames, each of said side leg frames comprising a front side crossed leg and a rear side crossed leg pivotally connected together where said front and rear side crossed legs cross, a front frame joint pivotally connected to a top end of said rear side crossed leg, and a back frame joint pivotally connected to a top end of said front side crossed leg, said back frame joint having top and bottom surfaces, said back frame comprising a pair of back frame legs slidably passing through said two back frame joints respectively;*

*wherein each of said back frame joints has a guiding hole for said back frame legs slidably passing through, and an inclined hole, said inclined hole being intercrossed with said guiding hole to form an inclined upper surface and an inclined lower surface, said inclined upper and lower surfaces being capable of supporting a lower side and a upper side of one of said back frame legs, and wherein each hole has a central axis, the intersection of the central axis of each hole being the intercross location and being located between a top surface of the joint and a bottom surface of the joint; and*

*an inclined back support arrangement which comprises a pair of back support coupling means, each for pivotally coupling a bottom end of one of said two back frame legs with a lower portion of one of said two rear side crossed*

*legs of said seat frame respectively, so as to support said two back frame legs in one of a plurality of inclined positions;*

*wherein said back frame legs and said back frame joints are capable of supporting a user in plural ones of said inclined positions:*

*wherein each of said back support coupling means includes a back support joint pivotally connected to said bottom end of said respective back frame leg and slidably coupled with said lower portion of said respective rear side crossed leg, and an inclination locker for firmly locking up one of a plurality of inclination angles of said respective back frame leg relative to said top surface of a respective one of said back frame joints when said folding furniture is fully unfolded;*

*wherein each of said inclination lockers comprises a locking plug associated with one of said back frame legs and an engagement rack affixed along an upper side of said lower portion of one of said rear side crossed legs, said engagement rack including a plurality of engagement sockets distributed along said engagement rack, and wherein each of said locking plugs is arranged to engage with a respective one of said engagement racks by insertion of one of said locking plugs into one of said engagement sockets; and*

*wherein said back frame legs may be inclinedly supported at one of said plurality of inclination angles relative to said top surface of one of said back frame joints when said chair is unfolded, said one of said plurality of inclination angles determined by which of said sockets said locking plug is inserted into.*

*37. A folding furniture, comprising:*

*a seat frame and a back frame constructed to support a fabric seat thereon, said seat frame comprising two side leg frames and a construction leg frame foldably supported between said two side leg frames, each of said side leg frames comprising a front side crossed leg and a rear side crossed leg pivotally connected together where said front and rear side crossed legs cross, a front frame joint pivotally connected to a top end of said rear side crossed leg, and a back frame joint pivotally connected to a top end of said front side crossed leg, said back frame joint having top and bottom surfaces, said back frame comprising a pair of back frame legs slidably passing through said two back frame joints, respectively;*

*wherein each of said back frame joints has a guiding hole for said back frame leg slidably passing through, and an inclined hole, said inclined hole being intercrossed with said guiding hole to form an inclined upper surface and an inclined lower surface, said inclined surfaces being capable of supporting a lower side and a upper side of said back frame leg, said inclined lower surface being inclined with respect to at least one of said top or bottom surfaces of the back frame joint, said inclined lower surface being non-perpendicular to at least one of said top or bottom surfaces of said back frame joint; and*

*an inclined back support arrangement which comprises a pair of back support coupling means, each for pivotally coupling a bottom end of one of said two back frame legs with a lower portion of one of said two rear side crossed legs of said seat frame respectively, so as to support said two back frame legs in one of a plurality of inclined positions;*

*wherein said back frame legs and said back frame joints are capable of supporting a user in plural ones of said inclined positions; and wherein said pair of back support coupling means includes a plurality of locations, spaced along a plane parallel to a longitudinal axis of each of said rear side crossed legs, at which the bottom ends of said respective back frame legs may be coupled, each of said plurality of locations providing a different corresponding angle between said top or bottom surface of one of said back frame joints and one of said back frame legs when said back frame legs are coupled at one of said plurality of locations;*

*wherein the guiding hole and the inclined hole each has a central axis and the intersection of the central axis of each hole being the intercross location and being located between a top surface of the joint and a bottom surface of the joint.*

*38. A folding furniture, comprising:*

*a seat frame and a back frame constructed to support a fabric seat thereon, said seat frame comprising two side leg frames and a construction leg frame foldably supported between said two side leg frames, each of said side leg frames comprising a front side crossed leg and a rear side crossed leg pivotally connected together where said front and rear side crossed legs cross, a front frame joint pivotally connected to a top end of said rear side crossed leg, and a back frame joint pivotally connected to a top end of said front side crossed leg, said back frame comprising a pair of back frame legs slidably passing through said two back frame joints respectively;*

*an inclined back support arrangement which comprises a pair of back support coupling means for pivotally coupling two bottom ends of said two back frame legs with two lower portions of said two rear side crossed legs of said seat frame respectively, so as to inclinedly support said two back frame legs in position; and*

*wherein each of said back frame joints has a guiding hole for said back frame leg slidably passing through, an inclined hole being intercrossed with said guiding hole to form an inclined lower surface for respectively supporting an upper side of said back frame leg, said inclined hole being inclined with respect to and non-perpendicular to at least one of the top or bottom planes of the back frame joint.*

*39. A folding furniture, comprising:*

*a seat frame and a back frame constructed to support a fabric seat thereon, said seat frame comprising two side leg frames and a construction leg frame foldably supported between said two side leg frames, each of said side leg frames comprising a front side crossed leg and a rear side crossed leg pivotally connected together where said front and rear side crossed legs cross, a front frame joint pivotally connected to a top end of said rear side crossed leg, and a back frame joint pivotally connected to a top end of said front side crossed leg, said back frame joint having top and bottom surfaces, said back frame comprising a pair of back frame legs slidably passing through said two back frame joints respectively;*

*wherein each of said back frame joints comprises a hole for said back frame leg slidably passing through, and wherein the cross sectional width of the back frame leg is substantially equal to a cross sectional distance of a narrowest portion of the hole, wherein the cross sectional distance of the narrowest portion of the hole is measured by the shortest distance between two points on opposite inner surfaces of the hole, and wherein that narrowest portion is at a position of the hole intermediate between top and bottom surfaces of the largest thickness of the back frame joint; and*

*an inclined back support arrangement which comprises a pair of back support coupling means, each for pivotally coupling a bottom end of one of said two back frame legs with a lower portion of each of said two rear side crossed legs of said seat frame respectively, so as to support said two back frame legs in one of a plurality of inclined positions;*

*wherein said back frame legs and said back frame joints are capable of supporting a user in plural ones of said inclined positions; and*

*wherein said inclined back support arrangement provides a plurality of locations, spaced along a plane parallel to a longitudinal axis each of said rear side crossed legs, at which the bottom ends of said respective back frame legs may be pivotally coupled, each of said plurality of locations providing a different corresponding angle between said top surface of one of said back frame joints and one of said back frame legs at which said back frame legs are inclinedly supported when said back frame legs are coupled to one of said plurality of locations;*

*wherein the hole has a right angular axis relative to a top surface of the joint and an inclined axis relative to the top edge, and an intersection of the axes being at an intercross location located between the top surface of the joint and bottom surface of the joint.*

* * * * *